US005747094A

United States Patent [19]

Liddell

[11] Patent Number: 5,747,094

[45] Date of Patent: May 5, 1998

[54] METHOD FOR CHECKING PAINT APPLIED TO A SURFACE

[75] Inventor: Kimm A. Liddell, Cincinnati, Ohio

[73] Assignee: Fibre Glass-Evercoat Company, Inc., Cincinnati, Ohio

[21] Appl. No.: 593,657

[22] Filed: Jan. 29, 1996

[51] Int. Cl.[6] ..... B05D 1/32; B05D 3/12

[52] U.S. Cl. ..... 427/8; 427/272; 427/282; 118/504

[58] Field of Search ..... 427/156, 272, 427/282, 9, 421, 8; 118/504; 428/195; 73/159

[56] References Cited

U.S. PATENT DOCUMENTS

| | | | |
|---|---|---|---|
| 4,082,875 | 4/1978 | Citron | 428/134 |
| 4,128,193 | 12/1978 | Nighswonger et al. | 222/402.21 |
| 4,598,003 | 7/1986 | Renholts | 428/40 |
| 5,113,921 | 5/1992 | Pool | 156/71 |

*Primary Examiner*—Shrive Beck
*Assistant Examiner*—Fred J. Parker
*Attorney, Agent, or Firm*—Killworth Gottman Hagan & Schaeff LLP

[57] ABSTRACT

Masking paper includes a black and white pattern formed thereon, preferably along at least one edge of the paper, with an area substantially adjacent a surface to be painted being masked using a patterned portion of the masking paper. The masking paper may include an adhesive on its back side, i.e. the side opposite the black and white pattern, at least on the portion of the back side generally opposite the patterned portion of the masking paper. Once properly masked, paint is applied to the surface to be painted with the painter running the paint pattern over a portion of the black and white pattern on the masking paper to gauge its coverage and/or color. If an additional check is desired, another portion of the pattern may be checked in the same manner. Since only the edges of the masking paper include the black and white pattern and since the black portion of the pattern does not cover even the patterned portions of the edges, light in a painting location is still enhanced using the masking paper of the present application.

7 Claims, 1 Drawing Sheet

100
102
104
106
108
110
112
114
116
118

METHOD FOR CHECKING PAINT APPLIED TO A SURFACE

BACKGROUND OF THE INVENTION

The present invention relates in general to checking coverage and color of paint applied to a surface and, more particularly, to such checking using a masking paper, for example a white masking paper, having a black and white pattern which may be a black and paper pattern, formed thereon, with the pattern preferably being formed on at least one edge of the paper. While the invention of the present application is generally applicable to a wide variety of painting applications, it will be described herein with reference to automotive painting for which it is particularly applicable and being initially utilized.

Masking paper packaged in various roll widths and lengths is used in many painting applications including automotive painting. The masking paper is secured adjacent to a surface to be painted either by masking tape or by adhesive applied to the back of the paper. A light color is preferred for the masking paper with a white "color" being best since it enhances the light available in a painting location, typically a booth for automotive painting. White masking paper is particularly advantageous in automotive painting applications since it is less likely to reflect or cast a color upon a surface being painted such that it will not affect the shade or hue of the paint. Thus, the accuracy of the paint color match is improved.

Most automotive paints are transparent, i.e., it is possible to see through one to several coats of paint. Accordingly, most applications require multiple coats of paint to achieve adequate and uniform coverage or hiding of the surface being painted, depending on the color of the paint and the color or colors of the surface. If a painter does not apply enough paint, i.e., number of coats of paint, the surface underneath will show through and have to be repainted. On the other hand, if a painter applies too much paint to ensure complete coverage, it adds to the cost of a paint job and increases the possibility of paint failure due to excessive film build-up.

This problem has been addressed in the past by the use of paint coverage cards which include a black and white pattern, such as a checkerboard pattern or half black and half white pattern. The paint coverage cards may also include a hole for color checking with a portion of an automobile which is being painted. In use, the painter coats a card to determine how many coats of paint are necessary to completely cover the black and white pattern so that the pattern can not be seen at all. If the card includes a hole, the color then can be checked by holding the painted card up to an existing portion of the automobile and viewing it through the hole.

Unfortunately, paint coverage cards create an additional expense for the painter and often more than one card may be used by the painter for a given paint job. In addition to the paint cards, masking paper must be purchased and used to mask areas adjacent to those which are to be painted such that those areas are protected during the painting operation.

There is a need for an improved paint checking arrangement which would reduce the costs of paint jobs, for example, by eliminating the cost of paint coverage cards. Any such arrangement should continue to provide the lighting enhancement provided by light or white colored masking paper, permit convenient paint coverage checking and preferably also provide color checking as well.

SUMMARY OF THE INVENTION

This need is met by the method and apparatus of the present invention wherein masking paper, for example white masking paper, includes black and white or black and paper patterns formed thereon, preferably, along at least one edge of the paper. An area adjacent a surface to be painted is masked using the masking paper with the pattern on the masking paper being placed substantially adjacent the surface to be painted. The masking paper is normally secured by masking tape; however, the masking paper may include an adhesive on its back side, i.e. the side opposite the black and white pattern, at least generally opposite the patterned portion of the masking paper.

Once properly masked, paint is applied to the surface to be painted with the painter running the paint pattern over the black and white pattern of the masking paper to gauge its coverage and color. If an additional check is desired, another portion of the pattern is checked in the same manner. In its preferred form, since only areas along the edges of the masking paper include the black and white pattern and since the black portion of the pattern does not cover even the area along the edges, light in a painting location is still enhanced using the masking paper of the present invention.

In accordance with one aspect of the present invention, masking paper having a first side for checking paint applied to a surface adjacent to an area masked by the masking paper and a second side comprises a paper sheet with a black and white or black and paper pattern formed on the first side and, preferably, along at least one edge of the paper sheet. The masking paper preferably is formed as a white paper sheet. The masking paper may further comprise adhesive applied to the second side of the paper sheet including at least the portion of the second side of the paper sheet generally opposite the black and white pattern. The paper sheet may be formed as a roll of masking paper having the black and white pattern preferably formed along at least one edge of the roll or along both edges of the roll and the black and white pattern may, for example, be a checkerboard pattern.

In accordance with another aspect of the present invention, a method for checking paint applied to a surface comprises the steps of: forming a black and white pattern on a first side of and, preferably, along at least one edge of a sheet of masking paper; applying the sheet of masking paper to an area adjacent a surface to be painted such that the black and white pattern is substantially adjacent the surface to be painted; painting the surface to be painted and at least a portion of the black and white pattern substantially adjacent the surface to be painted; and, evaluating the painted portion of the black and white pattern to check paint applied to the surface to be painted.

The method may further comprise the step of applying adhesive to a second side of the sheet of masking paper opposite the first side and including at least the portion of the second side of the sheet of masking paper generally opposite the black and white pattern. The method may still further comprise the step of forming the sheet of masking paper as a roll of masking paper wherein the step of forming a black and white pattern on a first side of and along at least one edge of the roll of masking paper comprises the step of forming the black and white pattern along at least one edge of the roll, for example as a checkerboard pattern. The step of forming a black and white pattern on a first side of and along at least one edge of the roll of masking paper may alternately comprise the step of forming the black and white pattern on the first side along both edges of the roll of masking paper, for example as a checkerboard pattern.

It is, thus, an object of the present invention to provide an improved method and apparatus for checking paint coverage and color by means of a black and white pattern formed on masking paper; to provide an improved method and apparatus for checking paint coverage and color by means of a black and white pattern formed along at least one edge of masking paper; and, to provide an improved method and apparatus for checking paint coverage and color by means of a black and white pattern formed along both edges of masking paper formed as a roll of masking paper.

Other objects and advantages of the invention will be apparent from the following description, the accompanying drawings and the appended claims.

DETAILED DESCRIPTION OF THE INVENTION

Figures 1, 2:
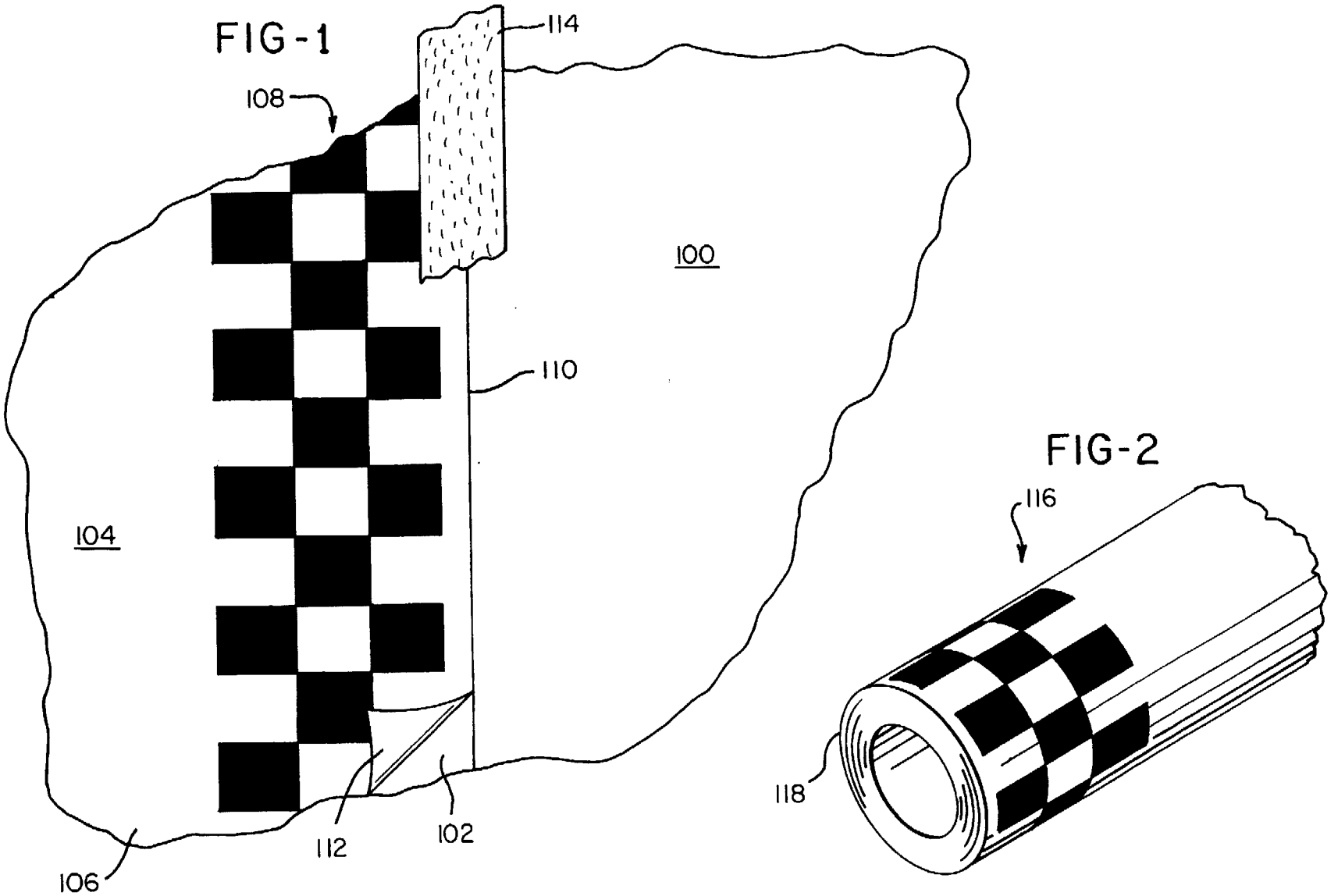
FIG. 1 is a broken-away portion of an automobile being painted utilizing the apparatus and method of the present invention.
FIG. 2 is a broken-away end portion of a roll of masking paper in accordance with the present invention.

While the invention of the present application is generally applicable to a wide variety of painting applications, it will be described with reference to automotive painting for which it is particularly applicable and being initially utilized. Reference will now be made to the drawings wherein FIG. 1 illustrates a portion of a surface 100 of an automobile which is to be painted. An area 102 of the automobile adjacent to the surface 100 to be painted has been masked with masking paper 104 in accordance with the present invention.

The masking paper 104 has one side, a first side 106, which is used for checking paint applied to the surface 100 to be painted and may be referred to herein as the front side of the masking paper 104. While the masking paper 104 may be of any color, it preferably comprises a white or light color sheet of paper which has a black and white pattern formed on the first side 106 of the masking paper 104. It is to be understood that a black and white pattern as used herein is meant to refer to a pattern of black or other very dark color and a white or other light color. Both the black and white or dark and light colors can be applied to the paper as by printing or otherwise. Alternately, the light color can be that of the paper, i.e., a black and paper pattern, by not printing or otherwise applying the white or light color of the pattern to the masking paper.

Further, the black and white pattern can be any conceivable pattern, such as bars of black on white, circles of black on white, stars of black on white, curvilinear black portions on white, and the like. For ease of illustration and to represent the vast variety of black and white patterns which can be used, a checkerboard pattern 108 is illustrated.

The black and white pattern is illustrated as being formed along at least one edge 110 of the masking paper 104; however, it need not be so positioned and certainly not immediately adjacent the at least one edge 110. It is preferred to form the pattern sufficiently close to an edge of the masking paper 104 such that it can be conveniently painted during the painting operation performed on the surface 100. As illustrated, the black and white pattern is closely spaced from the edge 110 of the masking paper 104 as may result from certain conventional printing operations which may be used to form the black and white pattern on the masking paper 104.

The back or second side 112 is illustrated by a turned back corner of the masking paper 104. Normally, the masking paper 104 is secured by means of masking tape 114 to the area 102 of the automobile adjacent to the surface 100 to be painted. The masking tape 114 is typically around ¾ inch wide such that approximately ⅜ inch of the masking tape 114 is secured to the masking paper 104 and ⅛ inch of the masking tape 114 is secured to the area to be masked. Of course, other sizes of masking tape can be used as desired or for given applications. The small spacing between the black and white pattern and the edge 110 of the masking paper 104, whether due to printing or the masking tape 114, does not inhibit operation of the present invention since paint is normally oversprayed several inches, typically around 3 to 5 inches, during painting.

Alternately, the second side 112 of the masking paper 104 may have an appropriate adhesive applied thereto along at least the edge of the masking paper 104. For example, the adhesive may be included on at least the portion of the second side 112 which is generally opposite the black and white pattern; however, the entire second side 112 of the masking paper 104 can be coated with adhesive. Since appropriate adhesives are well known in the art and are commonly used, they will not be described further herein.

The masking paper 104 may be packaged as rolls of masking paper in various widths and lengths. In FIG. 2, a broken-away end 116 of a roll of the masking paper 104 is illustrated. The black and white pattern is formed substantially adjacent an edge 118 of the roll and is illustrated as a checkerboard pattern even though a vast variety of patterns can be used in the present invention as previously noted. For convenience of application, it is currently preferred to form the black and white pattern along both edges of the masking paper 104, even though only one edge is shown in FIG. 2.

Since the black and white pattern is formed only along one or both edges of the otherwise plain masking paper and since the black portion of the black and white pattern does not cover even the portion of the edge or edges of the masking paper including the pattern, light in a painting location is still enhanced when using the masking paper 104 of the present invention.

Color checking can be performed by using white or light colored portions of the black and white pattern or a totally white or light colored portion of the masking paper 104, for example, by comparison to the area 102 of the automobile being painted.

While it is believed that the method of using the masking paper 104 of the present application is apparent from the foregoing description, for the sake of clarity, the method will now be described. In its broadest aspect, the method in accordance with the present invention for checking paint applied to a surface comprises the steps of: forming a black and white pattern on a first side of and, preferably, along at least one edge of a sheet of masking paper; applying the sheet of masking paper to an area adjacent a surface to be painted such that the black and white pattern is substantially adjacent the surface to be painted; painting the surface to be painted and at least a portion of the black and white pattern substantially adjacent the surface to be painted; and, evaluating the painted portion of the black and white pattern to check paint applied to the surface to be painted.

The method may further comprise the step of applying adhesive to a second side of the sheet of masking paper opposite the first side and including at least the portion of the second side of the sheet of masking paper generally opposite the black and white pattern. The method may still further comprise the step of forming the sheet of masking paper as a roll of masking paper wherein the step of forming a black and white pattern on a first side of and along at least one edge of a sheet of masking paper comprises the step of forming the black and white pattern along at least one edge of the roll, for example as a checkerboard pattern. The step of forming a black and white pattern on a first side of and along at least one edge of the roll of masking paper may alternately comprise the step of forming the black and white pattern on the first side along both edges of the roll of masking paper, for example as a checkerboard pattern.

Having thus described the invention of the present application in detail and by reference to preferred embodiments thereof, it will be apparent that modifications and variations are possible without departing from the scope of the invention defined in the appended claims.

What is claimed is:

1. A method for checking paint applied to a surface comprising the steps of:

forming a black and white pattern on a first side of a sheet of masking paper to form a patterned sheet of masking paper;

applying said patterned sheet of masking paper to an area adjacent a surface to be painted such that said black and white pattern is substantially adjacent said surface to be painted;

painting said surface to be painted and at least a portion of said black and white pattern substantially adjacent said surface to be painted; and using the painted portion of said black and white pattern to determine the coverage and color of paint applied to said surface to be painted.

2. A method as claimed in claim 1 wherein said step of forming a black and white pattern on a first side of a sheet of masking paper comprises the step of forming a black and white pattern along at least one edge of a sheet of masking paper to form said patterned sheet of masking paper.

3. A method as claimed in claim 2 further comprising the step of applying adhesive to a second side of said patterned sheet of masking paper generally opposite to said first side and including at least the portion of said second side of said patterned sheet of masking paper generally opposite said black and white pattern.

4. A method as claimed in claim 2 further comprising the step of forming said patterned sheet of masking paper as a roll of masking paper wherein the step of forming a black and white pattern along at least one edge of a sheet of masking paper comprises the step of forming said black and white pattern along at least one edge of said roll of masking paper.

5. A method as claimed in claim 4 wherein the step of forming a black and white pattern along at least one edge of said roll of masking paper comprises the step of forming said black and white pattern as a checkerboard pattern.

6. A method as claimed in claim 4 wherein said step of forming a black and white pattern along at least one edge of said roll of masking paper comprises the step of forming said black and white pattern on said first side along both edges of said roll of masking paper.

7. A method as claimed in claim 6 wherein the step of forming a black and white pattern on said first side along both edges of said roll of masking paper comprises the step of forming said black and white pattern as a checkerboard pattern.

* * * * *